US008408401B2

(12) United States Patent
Tawa et al.

(10) Patent No.: US 8,408,401 B2
(45) Date of Patent: Apr. 2, 2013

(54) OIL STRAINER FOR OUTBOARD MOTOR UNIT

(75) Inventors: Hiroki Tawa, Wako (JP); Masanori Tsubouchi, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 372 days.

(21) Appl. No.: 12/781,576

(22) Filed: May 17, 2010

(65) Prior Publication Data

US 2010/0300958 A1 Dec. 2, 2010

(30) Foreign Application Priority Data

May 27, 2009 (JP) ..... P2009-128106

(51) Int. Cl.
*B01D 35/02* (2006.01)

(52) U.S. Cl. ..... 210/416.5; 210/232

(58) Field of Classification Search ..... 210/232, 210/416.5, 435, 439
See application file for complete search history.

(56) References Cited

U.S. PATENT DOCUMENTS

| | | | | |
|---|---|---|---|---|
| 4,066,281 | A | 1/1978 | De Bonis | |
| 4,909,203 | A * | 3/1990 | Fukuo | 123/196 R |
| 7,087,160 | B2 * | 8/2006 | Beer et al. | 210/167.02 |
| 2009/0045129 | A1 * | 2/2009 | Jinbo et al. | 210/416.5 |

FOREIGN PATENT DOCUMENTS

| | | | |
|---|---|---|---|
| DE | 39 13 813 | A1 | 11/1989 |
| JP | 61-17111 | | 1/1986 |
| JP | 62-16734 | | 1/1987 |
| JP | 63-65112 | A | 3/1988 |
| JP | 63-90012 | | 6/1988 |
| JP | 05-033779 | A | 2/1993 |
| JP | 09-317430 | | 12/1997 |
| JP | 2003-262133 | | 9/2003 |
| JP | 2003-334406 | A * | 11/2003 |
| JP | 2008-232017 | | 10/2008 |

OTHER PUBLICATIONS

Machine-Generated English Translation of JP 2003-334406A, generated on Aug. 7, 2012.*

Canadian Office Action for Patent Application No. 2,703,420.

Japanese Notification of Reasons for Refusal (P2009-128106) mailed Oct. 2, 2012 with Partial Translation.

* cited by examiner

*Primary Examiner* — Fred Prince

(74) *Attorney, Agent, or Firm* — Arent Fox LLP

(57) ABSTRACT

An internal oil strainer housed in an outboard motor unit. A lower end of an oil tube is supported by a first seal member constructed of an O-ring fitted into an oil outlet of a strainer case. An upper end of the oil tube is supported by a second seal member constructed of an O-ring fitted into an inlet of an oil channel.

5 Claims, 7 Drawing Sheets

OIL STRAINER FOR OUTBOARD MOTOR UNIT

FIELD OF THE INVENTION

The present invention relates to an oil strainer housed in an outboard motor unit.

BACKGROUND OF THE INVENTION

Outboard motor units have been known in the past as apparatuses for providing propulsion force to boats and other waterborne vehicles, as disclosed, for example, in Japanese Patent Application Laid-Open Publication No. HEI-05-33779 (JP H05-33779 A).

FIG. 7 hereof shows the outboard motor unit disclosed in JP H05-33779 A.

An engine 102 covered by an engine cover 101 is provided to an upper part of the outboard motor unit 100, as shown in FIG. 7(*a*). The outboard motor unit 100 has a stern bracket 105 and is attached to a back end 104 of a waterborne vehicle 103 via the stern bracket 105. The engine 102 is supported by a mount case 106. An oil pan 107 is attached to an underside of the mount case 106. The internal structure of the oil pan 107 is described on the basis of FIG. 7(*b*).

With reference to FIG. 7(*b*), the oil strainer 109 is connected to the suction port 108 of an oil pump. The oil strainer 109 is attached to the mount case 106 via a supporting member 111.

The oil strainer 109 disclosed in Japanese Laid-open Patent Application No. 5-33779 is integrally constructed from a strainer case 112 in which an element is housed, and an oil tube 113 for connecting the strainer case 112 and the suction port 108 of the oil pump. Therefore, the position of the strainer case 112 is fixed. It is necessary to newly prepare an oil strainer having an oil tube of a different length when the position of the strainer case 112 is changed as needed. The result is an increase in the replacement cost of oil strainers.

SUMMARY OF THE INVENTION

It is therefore an object of the present invention to provide an oil strainer for an engine used in an outboard motor unit wherein the position of the oil strainer can be varied at a low cost.

According to an aspect of the present invention, there is provided an oil strainer adapted to be disposed in a suction area of an oil pump of an outboard engine unit, for filtering oil and supplying the filtered oil to the oil pump via an oil channel, which oil strainer comprises: a strainer case with a filtering element housed therein, the strainer case being provided with an oil inlet and an oil outlet; an oil tube extending from the oil outlet to an inlet of the oil channel; a first seal member fitted into one end of the oil tube and compressed at the oil outlet to operate as a seal; and a second seal member fitted into an opposite end of the oil tube and compressed at the inlet to the oil channel to operate as a seal, wherein the oil tube is supported at both ends by the first seal member and the second seal member.

With this arrangement, the oil tube can be easily removed from the strainer case. In cases in which the situation demands that the position of the strainer case be changed, only the oil tube of a different length should be prepared, and the strainer case can be used with the new tube. Hence, the position of the strainer case can be changed at a lower cost compared with an oil strainer integrally constructed of a strainer case and an oil tube. Accordingly, there can be provided an oil strainer for use in an outboard motor unit wherein the position of the strainer case can be changed at a low cost.

Preferably, each of the first seal member and the second seal member comprises an O-ring. O-rings are readily available and inexpensive. Hence, it is possible to reduce the manufacturing cost of the oil strainer.

Desirably, the one end of the oil tube has a first stepped part for restricting axial movement of the first seal member while the opposite end of the oil tube has a second stepped part for restricting axial movement of the second seal member. As a result, the first seal member will not go beyond the first stepped part, and the second seal member will not go beyond the second stepped part. For this reason, the first seal member and the second seal member remain in a predetermined area, allowing the sealing properties of the oil outlet of the strainer case and the inlet of the oil channel to be further improved.

In a preferred form, the strainer case include a case lower half formed of a resin material having the oil inlet, and a case upper half formed of a resin material having the oil outlet. Therefore, the strainer case can be made more lightweight compared with cases in which the two case halves are made of metal.

It is desirable that the element be wedged between the case lower half and the case upper half, and be joined to the case lower half and the case upper half by a thermal welded part. Accordingly, the strainer case can be made more lightweight compared with cases in which the two case halves are integrated by bolting.

BRIEF DESCRIPTION OF THE DRAWINGS

A preferred embodiment of the present invention will be described in detail below, by way of example only, with reference to the accompanying drawings, in which.

DESCRIPTION OF THE PREFERRED EMBODIMENT

Figure 1:
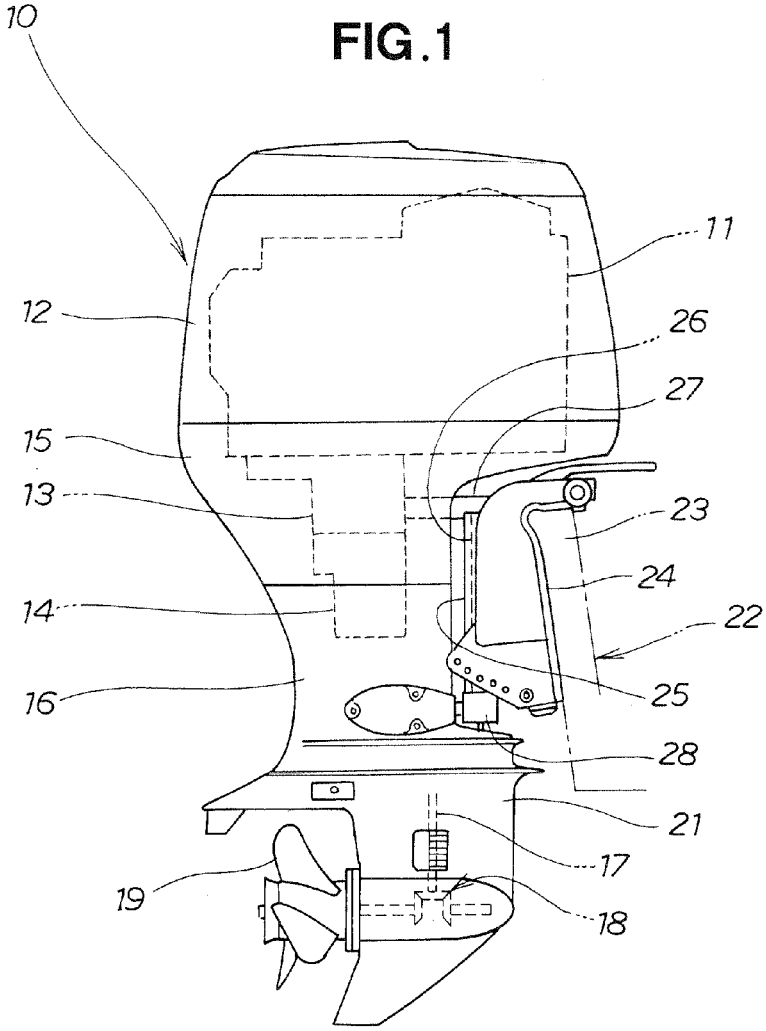
FIG. 1 is a side elevational view showing an outboard engine unit having an oil strainer according to the present invention.

An outboard motor unit 10 shown in FIG. 1 includes an engine cover 12 that covers an engine 11, the cover being provided to an upper part; an undercover 15 connected to a lower end of the engine cover 12 and made to extend downward while covering a lower part of the engine 11, a mount case 13, and an upper half of an oil pan 14; an extension cover 16 connected to a lower end of the undercover 15 and used to cover a lower half of the oil pan 14; and a gear case 21 connected to a lower end of the extension cover 16 and used to house a gear mechanism 18 and a drive shaft 17 linked to a crankshaft of the engine 11. A propeller 19 is rotated via the gear mechanism 18 and the drive shaft 17 by the running of the engine 11.

The outboard motor unit 10 is provided with a stern bracket 24 attached to a back end 23 of a boat or other waterborne vehicle 22, a swivel case 25 rotatably attached to the stern bracket 24, a backwardly extending mount frame 27 supporting the mount case 13 and having a swivel shaft 26 rotatably inserted into the swivel case 25, and a backwardly extending lower mount center housing 28 linked to the lower end of the swivel shaft 26 and to the extension cover 16.

In addition, an oil strainer 30 (described in detail below) is provided to the interior of the oil pan 14.

Figure 2:
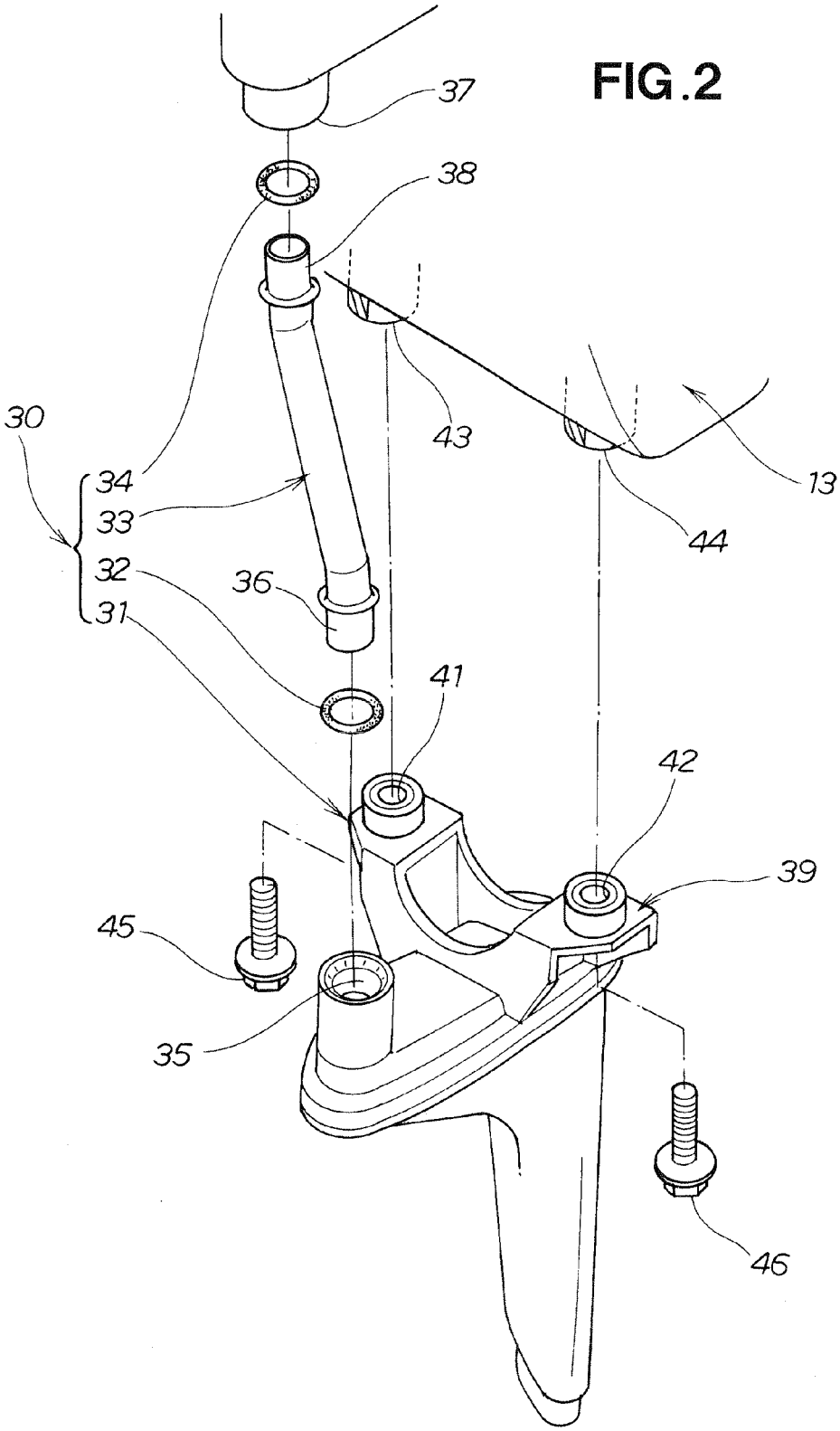
FIG. 2 is an exploded perspective view of the oil strainer according to the present invention.

The oil strainer 30 is constructed of a strainer case 31 disposed at the very bottom, a lower O-ring (first seal member) 32 disposed above the strainer case 31, an oil tube 33 disposed above the lower O-ring 32, and an upper O-ring (second seal member) 34 disposed above the oil tube 33, as shown in FIG. 2.

The oil strainer 30 is assembled by fitting the lower O-ring 32 and a lower end 36 of the oil tube 33 in an oil outlet 35 of the strainer case 31, fitting the upper O-ring 34 and an upper end 38 of the oil tube 33 in an inlet 37 of an oil channel (described in detail below), and attaching two bolts 45, 46 to two connector holes 41, 42 provided via a reinforcing part 39 to an upper part of the strainer case 31 and two connecting screw holes 43, 44 (described in detail below) provided to the mount case 13.

The oil tube 33 has a shape symmetrical at the top and bottom. Because the shape is symmetrical at the top and bottom, the orientation has no effect when the oil tube 33 is inserted into the oil outlet 35 of the strainer case 31 and the inlet 37 to the oil channel. Therefore, the oil tube 33 is easier to assemble because the oil tube 33 can be inserted into the oil outlet 35 of the strainer case 31 and the inlet 37 to the oil channel without regard for the vertical direction. The following is a detailed description of the structure of the oil strainer 30.

Figure 3:
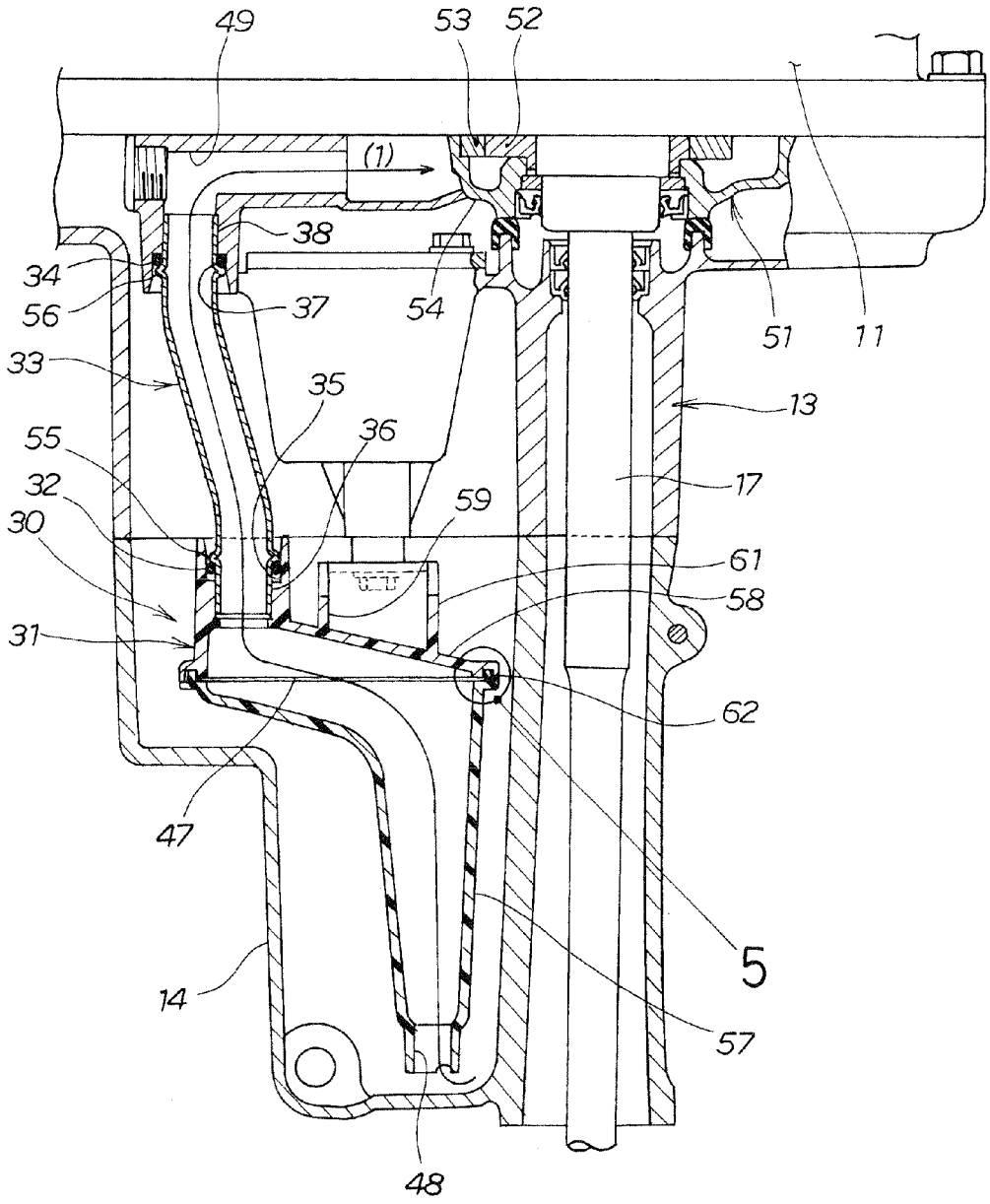
FIG. 3 is a cross-sectional view illustrating the oil strainer of FIG. 2.

As shown in FIG. 3, the oil strainer 30 includes the strainer case 31 constructed, for example, of a woven wire mesh, used to house an oil-filtering element 47, provided with an oil inlet 48 and the oil outlet 35, and connected to the mount case 13 (the connection structure is described below); the oil tube 33 extending from the oil outlet 35 to the inlet 37 of an oil channel 49 formed in the mount case 13; the lower O-ring 32 fitted into the lower end 36 of the oil tube 33, compressed at the oil outlet 35, and made to operate as a seal; and the upper O-ring 34 fitted into the upper end 38 of the oil tube 33, compressed at the inlet 37 of the oil channel 49, and made to operate as a seal.

The element 47 in the embodiment is constructed of a woven metal mesh, but the element may be constructed of a perforated plate.

An oil pump 51 is provided to the mount case 13 so as to be disposed on the right side of the oil channel 49. The oil pump 51 is constructed of an inner rotor 52 attached to the drive shaft 17 linked to the crankshaft of the engine 11, an outer rotor 53 in gear with the inner rotor 52, and a pump casing 54 for rotatably supporting the outer rotor 53.

Because the oil strainer 30 is disposed in the suction area of the oil pump 51, the oil in the oil pan 14 is drawn through the oil inlet 48 of the oil strainer 30, the element 47, the oil tube 33, and the oil channel 49 along arrow (1) when the engine 11 is started and the oil pump 51 is operated. The indrawn oil is supplied to each part of the engine 11 from the oil pump 51.

In addition, the first seal member is the lower O-ring 32, and the second seal member is the upper O-ring 34. O-rings are readily available and inexpensive. As a result, it is possible to reduce the manufacturing cost of the oil strainer 30.

Additionally, a first stepped part 55 for restricting axial movement of the lower O-ring 32 is provided to the lower end 36 of the oil tube 33, and a second stepped part 56 for restricting axial movement of the upper O-ring 34 is provided to the upper end 38 of the oil tube 33. The lower O-ring 32 will not go beyond the first stepped part 55, and the upper O-ring 34 will not go beyond the second stepped part 56. For this reason, the lower O-ring 32 and the upper O-ring 34 remain in a predetermined area, allowing the sealing properties of the oil outlet 35 of the strainer case 31 and the inlet 37 of the oil channel 49 to be further improved.

The strainer case 31 is further constructed of a case lower half 57 formed of a resin material having the oil inlet 48, and a case upper half 58 formed of a resin material having the oil outlet 35. Because the two case halves 57, 58 are constructed of a resin material, the strainer case 31 can be made more lightweight compared with cases in which the two case halves are made of metal.

Reinforcing ribs 59, 61 extending forward from the case upper half 58 are members that constitute one part of a reinforcing part 39 (FIG. 2).

In addition, the case lower half 57 and the case upper half 58 are joined by a thermal welded part 62 (described in detail below). The following is a description of the connection structure of the strainer case 31 and the mount case 13.

Figure 4:
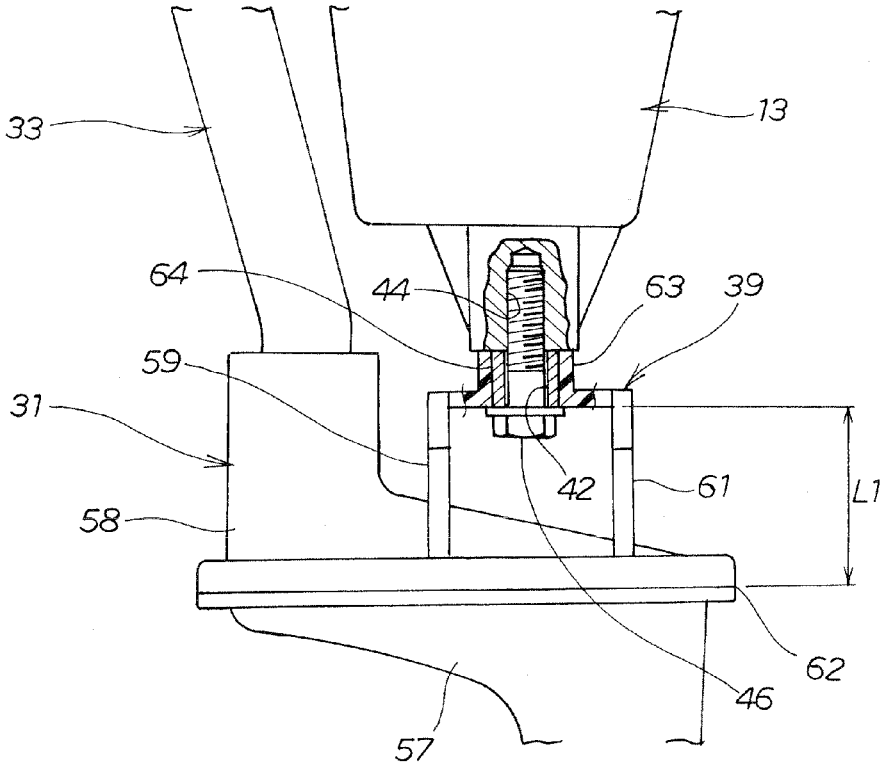
FIG. 4 is a partial cross-sectional view illustrating a strainer case and a mount case at a connection.

The strainer case 31 is attached to the mount case 13 by passing the bolt 46 through the connector hole 42 and screwing the bolt into the connecting screw hole 44 in the mount case 13, as shown in FIG. 4. The connector hole 42 is formed by attaching a cylindrical member 64 to a connector 63.

In the strainer case 31, the length L1 from a surface of the element (here, the thermal welded part 62) to the fastening part of the bolt 46 is made small. Therefore, even in cases in which the oil drawn up by the oil pump 51 (FIG. 3) collides with the element 47 (FIG. 3) and vibration occurs, the load applied to the fastening part of the bolt 46 can be reduced. The following describes the structure of the thermal welded part 62 of the case lower half 57 and the case upper half 58.

Figure 5:
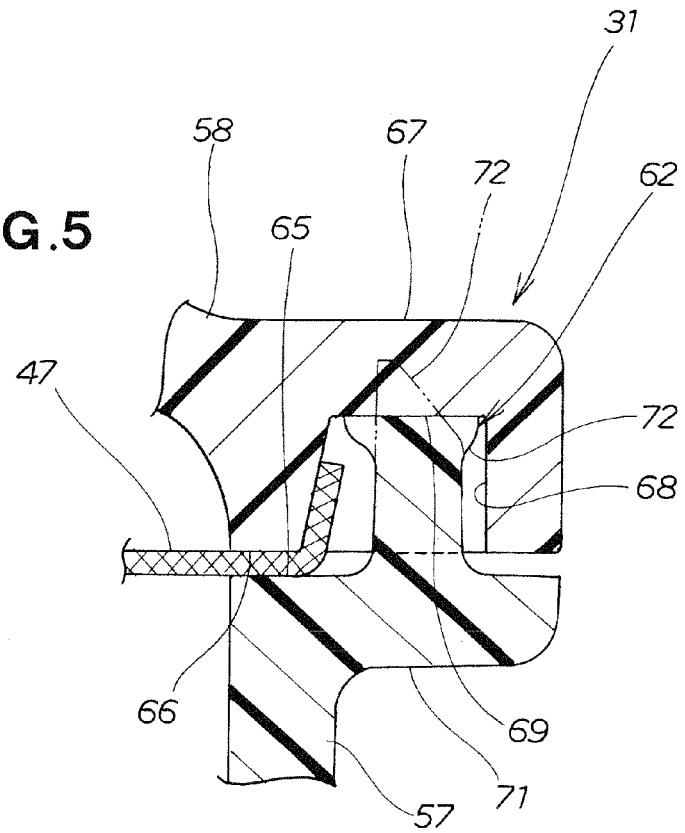
FIG. 5 is an enlarged view of region 5 of FIG. 3.

As shown in FIG. 5, the thermal welded part 62 is a region in which a welded member 72 extending upward from an end part 71 of the case lower half 57 is joined by heat to a welded surface 69 of a depressed part 68 formed so as to form a downward concavity in an end part 67 of the case upper half 58 in a state in which the element 47 is wedged between an upper surface 65 of the case lower half 57 and a lower surface 66 of the case upper half 58. A distal end of the welded member 72 protrudes before welding as shown by the imaginary line, and is flattened by heat after welding.

That is, the element 47 is wedged between the case lower half 57 and the case upper half 58 in the strainer case 31, and the case upper half 57 and the case lower half 58 are joined together by the thermal welded part 62. Because the case lower half 57 and the case upper half 58 are joined by the thermal welded part 62, the strainer case 31 can be made more lightweight compared with cases in which the two case halves 57, 58 are integrated by bolting.

Described next is the operation of the oil strainer described above. Specifically, a description is given of the attachment sequence all the way to the attachment of the oil tube to the inlet of the oil channel, which continues to the oil outlet of the strainer case and the oil pump.

Figure 6:
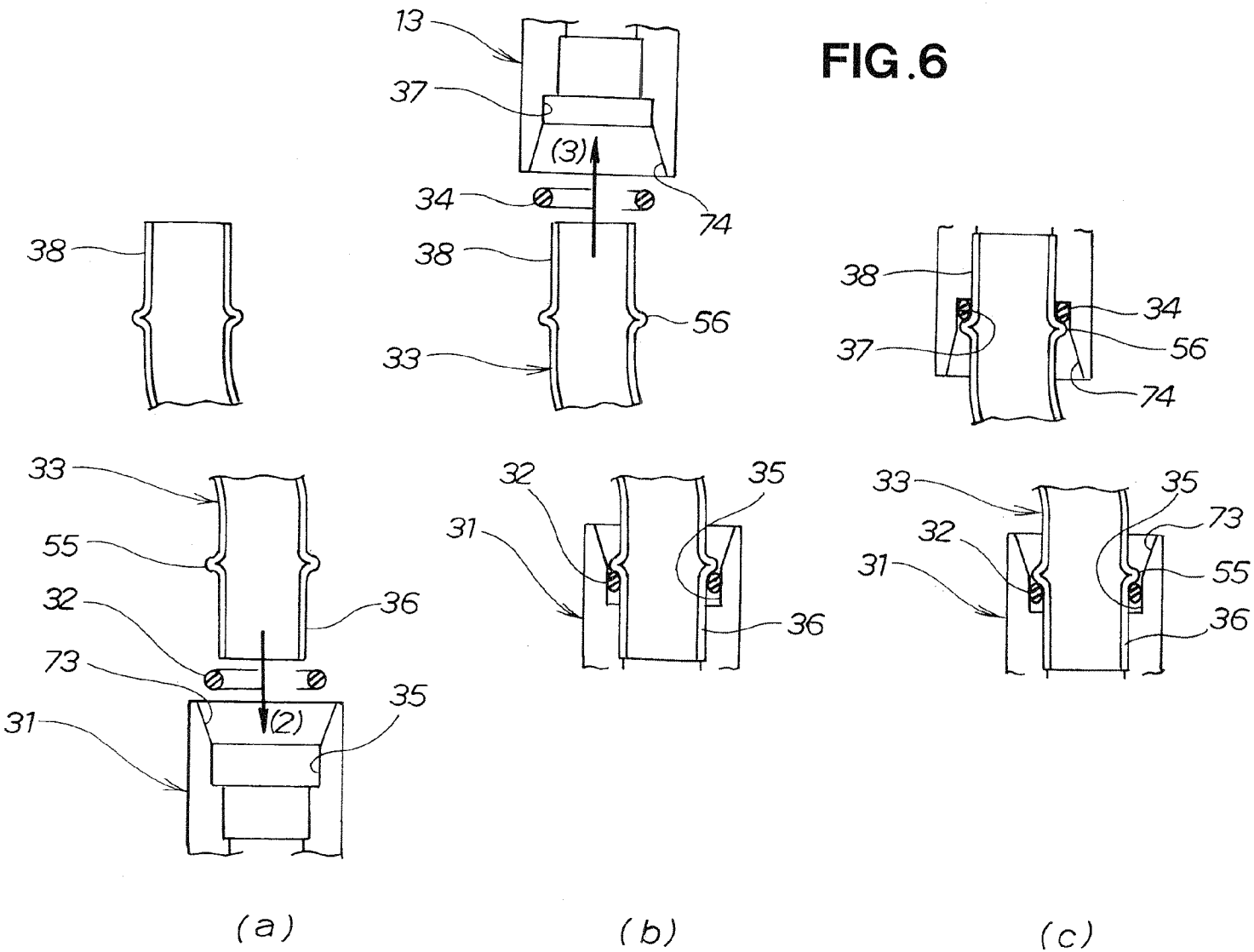
FIG. 6 is a view illustrating a mode of attachment of an oil tube.
Figure 7:
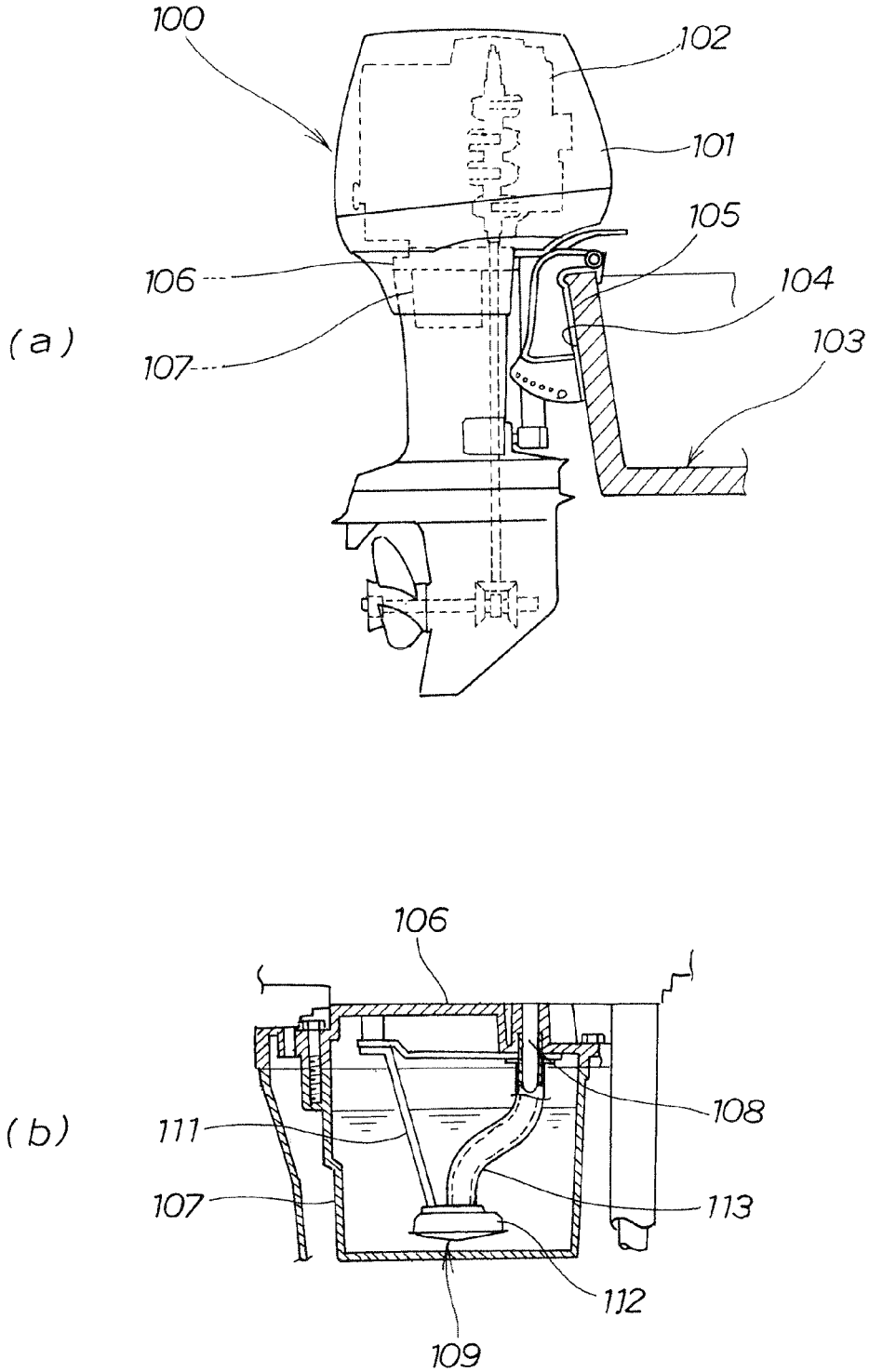
FIG.7 (PRIOR ART)
FIG. 7 is a view showing a conventional outboard motor unit and oil strainer.

The lower O-ring 32 and the lower end 36 of the oil tube 33 are inserted into the oil outlet 35 of the strainer case 31 along arrow (2), as shown in FIG. 6(*a*).

The upper end 38 of the oil tube 33 and the upper O-ring 34 are then inserted into the inlet 37 of the oil channel 49 (FIG. 3) along arrow (3), as shown in FIG. 6(*b*).

The result is that the lower end 36 of the oil tube 33 is supported by the lower O-ring 32 fitted into the oil outlet 35 of the strainer case 31, and the upper end 38 is supported by the upper O-ring 34 fitted into the inlet 37 of the oil channel, as shown in FIG. 6(*c*).

The lower end 36 of the oil tube 33 is supported by the lower O-ring 32 inserted into the oil outlet 35 of the strainer case 31, and the upper end 38 is supported by the upper O-ring 34 inserted into the inlet 37 of the oil channel. Therefore, the oil tube 33 can be easily removed from the strainer case 31. In cases in which the situation demands that the position of the strainer case 31 be changed, only the oil tube 33 of a different length should be prepared, and the strainer case 31 can be used with the new tube.

In the oil strainer 30 (FIG. 2) according to the present invention, the position of the strainer case 31 can therefore be changed at a lower cost compared with an oil strainer integrally constructed of a strainer case and an oil tube. Accordingly, there can be provided an oil strainer for use in an outboard motor unit wherein the position of the strainer case 31 can be changed at a low cost.

In addition, the lower O-ring 32 is used to seal the lower end 36 of the oil tube 33, and the upper O-ring 34 is used to seal the upper end 38 of the oil tube 33. The oil-sealing properties can be maintained, and the vibrations transmitted from the oil tube 33 to the strainer case 31 can be reduced by using the lower O-ring 32 and the upper O-ring 34.

A tapered part 73 is further provided to an upper end of the strainer case 31, as shown in FIG. 6(*c*). The presence of the tapered part 73 allows the lower O-ring 32 to be smoothly fitted into the oil outlet 35. A tapered part 74 is provided to a lower end of the mount case 13. The presence of the tapered part 74 allows the upper O-ring 34 to be smoothly fitted into the inlet 37 of the oil channel.

In this embodiment, O-rings are used for the first seal member and the second seal member according to the present invention, but soft resin members, rubber members, or members constructed by combining resin and rubber can also be used, making it possible to use a general seal material.

The oil strainer of the present invention can be used in an outboard motor unit.

Obviously, various minor changes and modifications of the present invention are possible in light of the above teaching. It is therefore to be understood that within the scope of the appended claims the invention may be practiced otherwise than as specifically described.

What is claimed is:

1. An oil strainer adapted to be disposed in a suction area of an oil pump of an outboard engine unit, for filtering oil and supplying the filtered oil to the oil pump via an oil channel, the oil strainer comprising:

a strainer case with a filtering element housed therein, the strainer case being provided with an oil inlet and an oil outlet;

an oil tube extending from the oil outlet to an inlet of the oil channel, the oil tube having a first end and a second end opposite to the first end, the first end of the oil tube having a first outwardly stepped part, and the second end of the oil tube having a second outwardly stepped part;

a first seal member fitted on to the first end of the oil tube and compressed at the oil outlet to operate as a seal; the first outwardly stepped part, restricting axial movement of the first seal member; and a second seal member fitted on to the second end of the oil tube and compressed at the inlet to the oil channel to operate as a seal, the second outwardly stepped part restricting axial movement of the second seal member, wherein the oil tube is supported at both ends by the first seal member and the second seal member and is removable from the strainer case.

2. The oil strainer of claim 1, wherein each of the first seal member and the second seal member comprises an O-ring.

3. The oil strainer of claim 1, wherein the strainer case comprises a case lower half formed of a resin material having the oil inlet, and a case upper half formed of a resin material having the oil outlet.

4. The oil strainer of claim 3, wherein the element is wedged between the case lower half and the case upper half, and is joined to the case lower half and the case upper half by a thermal welded part.

5. The oil strainer of claim 1, wherein the oil outlet of the strainer case has a tapered part at an outer end thereof for allowing the first seal member to be smoothly fitted into the oil outlet of the strainer case, and the oil inlet of the oil channel has a tapered part at an outer end thereof for allowing the second seam member to be smoothly fitted into the oil inlet of the oil channel.

* * * * *